US010550850B2

(12) United States Patent
Rodrigues

(10) Patent No.: US 10,550,850 B2
(45) Date of Patent: Feb. 4, 2020

(54) PUMP FOR CONVEYING A HIGHLY VISCOUS FLUID

(71) Applicant: Sulzer Management AG, Winterthur (CH)

(72) Inventor: Arnaldo Rodrigues, Winterthur (CH)

(73) Assignee: SULZER MANAGEMENT AG, Winterthur (CH)

( * ) Notice: Subject to any disclaimer, the term of this patent is extended or adjusted under 35 U.S.C. 154(b) by 491 days.

(21) Appl. No.: 15/271,795

(22) Filed: Sep. 21, 2016

(65) Prior Publication Data

US 2017/0107996 A1 Apr. 20, 2017

(30) Foreign Application Priority Data

Oct. 14, 2015 (EP) ..... 15189843

(51) Int. Cl.

| | |
|---|---|
| ***F04D 29/16*** | (2006.01) |
| ***F04D 1/00*** | (2006.01) |
| ***F04D 7/04*** | (2006.01) |
| ***F04D 29/22*** | (2006.01) |
| ***F04D 29/42*** | (2006.01) |

(52) U.S. Cl.

CPC ..... *F04D 29/167* (2013.01); *F04D 1/006* (2013.01); *F04D 7/04* (2013.01); *F04D 29/2266* (2013.01); *F04D 29/2294* (2013.01); *F04D 29/4293* (2013.01)

(58) Field of Classification Search

CPC ..... F04D 1/006; F04D 7/04; F04D 29/167; F04D 29/2266; F04D 29/2294; F04D 29/4293

See application file for complete search history.

(56) References Cited

U.S. PATENT DOCUMENTS 2,661,698 A 3/1951 Schellens
4,867,638 A * 9/1989 Handtmann ..... F04D 29/167 415/172.1

(Continued)

FOREIGN PATENT DOCUMENTS

DE 29722288 U1 1/1998

OTHER PUBLICATIONS

Centrifugal Pumps for Petroleum, Petrochemical and Natural Gas Industries, ANSI/API Standard 610, Eleventh Edition, Sep. 2010, American Pertroleum Institute, pp. 1-18 and 38-40 (Year: 2010).*

(Continued)

*Primary Examiner* — Brian P Wolcott

(74) *Attorney, Agent, or Firm* — Global IP Counselors, LLP

(57) ABSTRACT

A pump for conveying a highly viscous fluid includes a casing with at least a first inlet and an outlet for the fluid, and an impeller for conveying the fluid from the inlet to the outlet. The impeller is arranged on a rotatable shaft for rotation around an axial direction, and includes a front shroud facing the first inlet of the pump. The casing includes a stationary impeller opening for receiving the front shroud of the impeller and has a diameter. The front shroud and the stationary impeller opening form a gap having a width in a radial direction perpendicular to the axial direction, and the ratio of the width of the gap and the diameter of the impeller opening is at least 0.0045.

15 Claims, 6 Drawing Sheets

(56) References Cited

U.S. PATENT DOCUMENTS

| | | | | | |
|---|---|---|---|---|---|
| 4,909,707 | A * | 3/1990 | Wauligman | F04D 29/167 415/172.1 |
| 5,411,367 | A * | 5/1995 | Walker | F04D 29/167 415/170.1 |
| 6,494,675 | B2 * | 12/2002 | Pesek | F04D 29/167 277/411 |
| 9,567,864 | B2 * | 2/2017 | Iurisci | F01D 5/043 |
| 2014/0356127 | A1 | 12/2014 | Guelich | |

OTHER PUBLICATIONS

Extended European Search Report dated May 10, 2016 in EP Patent Application No. 15189843.4, filed Oct. 14, 2015.

* cited by examiner

PUMP FOR CONVEYING A HIGHLY VISCOUS FLUID

CROSS-REFERENCE TO RELATED APPLICATIONS

This application claims benefit to European Application No. 15189843.4, filed Oct. 14, 2015, the contents of which is hereby incorporated herein by reference.

BACKGROUND

Field of the Invention

The invention relates to a pump for conveying a highly viscous fluid.

Background of the Invention

Pumps for pumping highly viscous fluids are used in many different industries, for example in the oil and gas processing industry for conveying hydrocarbon fluids. Here, these pumps are used for different applications such as extracting the crude oil from the oil field, transportation of the oil or other hydrocarbon fluids through pipelines or within refineries. But also in other industries, for example, in the food industry or the chemical industry there is often the need for conveying highly viscous fluids.

The viscosity of a fluid is a measure for the internal friction generated in a flowing fluid and a characteristic property of the fluid. Within the framework of this application the term "viscosity" or "viscous" is used to designate the kinematic viscosity of the fluid and the term "highly viscous fluid" shall be understood such, that the fluid has a kinematic viscosity of at least $10^{-4}$ $m^2/s$, which is 100 centistokes (cSt).

For the pumping of highly viscous fluids it is known to utilize centrifugal pumps. Pumping highly viscous fluids with centrifugal pumps requires considerably more pump power than for example pumping water. The higher the viscosity of the fluid becomes the more power the pump needs to deliver the required pumping volume. Especially in the oil and gas industry the main focus—at least in the past—has been on pumping volume, i.e. the flow generated by the pump, and on the reliability of the pump rather than the efficiency of the pump. However, nowadays a more efficient use of the pump is strived for. It is desirable to have the highest possible ratio of the power, especially the hydraulic power, delivered by the pump to the power needed for driving the pump. This desire is mainly based upon an increased awareness of environment protection and a responsible dealing with the available resources as well as on the increasing costs of energy.

To improve the efficiency of a pump for pumping highly viscous fluids it is known to use specific impeller designs, especially impellers with high head coefficients. The head coefficient of the impeller can be increased for example by increasing the blade outlet angle or the number of blades or the impeller outlet width. Despite of these measures there is still a need to even more improve the efficiency of a pump for pumping highly viscous fluids.

SUMMARY

Therefore, it is an object of the invention to propose a new pump for conveying highly viscous fluids that has a better efficiency, i.e. an increased ratio of the power delivered by the pump when pumping the fluid to the power that is supplied to the pump for driving the pump.

The subject matter of the invention satisfying this object is characterized by the features described herein.

Thus, according to the invention a pump for conveying a highly viscous fluid is proposed, comprising a casing with at least a first inlet and an outlet for the fluid, an impeller for conveying the fluid from the inlet to the outlet, wherein the impeller is arranged on a rotatable shaft for rotation around an axial direction, and comprises a front shroud facing the first inlet of the pump, wherein the casing includes a stationary impeller opening for receiving the front shroud of the impeller and having a diameter, wherein the front shroud and the stationary impeller opening form an gap having a width in a radial direction perpendicular to the axial direction, wherein the ratio of the width of the gap and the diameter of the impeller opening is at least 0.0045.

The invention is in particular based upon the finding that the pump efficiency may be increased when pumping highly viscous fluids by designing the gap between the front shroud of the impeller and the stationary impeller opening considerably broader in the radial direction than it has been done in the prior art. The width of the gap is the extension of the gap with respect to the radial direction and usually also designated as the clearance or the radial clearance. This radial clearance is the minimum distance between the outer circumferential surface of the impeller's front shroud and the inner circumferential surface of the stationary impeller opening along the gap.

The gap which is sometimes also designated as the labyrinth is needed for sealing the high pressure side of the impeller, more particular the side room, against the inlet of the pump. The impeller is arranged in the stationary impeller opening which is a part of the pump that is stationary with respect to the casing and adapted to receive the impeller. In the mounted state the impeller is located in said impeller opening such that there is the gap or the labyrinth between the outer circumferential surface of the impeller's front shroud and the inner circumferential surface of the stationary impeller opening. This gap has a width in the radial direction, namely the clearance, and a length in the axial direction and provides a sealing between the side room on the high pressure side of the impeller and the inlet of the pump, which is the low pressure side of the pump.

During operation of the pump a back flow is generated flowing from the high pressure side of the impeller, which is for a single stage pump the region near the outlet of the pump, through the side room, and through the gap between the front shroud and the stationary impeller opening back to the low pressure side of the impeller. Thus, the back flow through the gap is flowing in the opposite direction as the fluid flowing through the respective inlet.

The gap or the labyrinth, respectively, is designed as a radial clearance seal or labyrinth, i.e. it provides a clearance with respect to the radial direction. Therefore, the main flow through the gap is in axial direction, i.e. parallel to the shaft. This has to be differentiated from an axial clearance seal or labyrinth that extends perpendicularly or obliquely to the shaft, thus the main flow through an axial clearance seal is in radial direction or oblique with respect to the radial direction. In an axial clearance seal the clearance in axial direction changes upon a relative movement of the stationary part and the rotating part in axial direction, wherein in a radial clearance seal the clearance in radial direction changes upon a relative movement of the stationary part and the rotating part in radial direction.

An essential finding is that by the larger width in the radial direction (i.e. the clearance) of the gap (i.e. the labyrinth) proposed by the invention the power losses across the gap are decreasing inter alia due to the reduced drag in the side room. On the other hand one may expect that the larger width of the gap would result in a reduced sealing action thus increasing the back flow in the pump. However an increase in the back flow rate reduces the pump efficiency and thus contravenes an improved efficiency. Therefore the unexpected finding is that by increasing the width of the gap with respect to the radial direction the overall pump efficiency increases despite the risk of an enhanced back flow rate.

According to the invention the width of the gap shall be at least 0.0045 times the diameter of the impeller opening.

The optimal width of the gap depends on several factors for example the viscosity of the fluid. Thus, depending on the specific application it may be preferred that the ratio of the width of the gap and the diameter of the impeller opening is at least 0.0050.

For practical reasons and for providing a sufficient sealing action there is also a preferred upper limit for the width of the gap. According to the preferred design, the ratio of the width of the gap and the diameter of the impeller opening is at most 0.0070. This upper limit is preferred for many applications. However, there might be applications for which it is advantageous, if the width of the gap is even larger than 0.0070 times the diameter of the impeller opening.

In order to generate the desired sealing effect by the gap it is preferred that the gap has a length in the axial direction which is at least 0.092 times the diameter of the impeller opening. The length of the gap or the labyrinth is the extension of the gap with respect to the axial direction that is the length of the region with a minimum distance between the outer circumferential surface of the impeller's front shroud and the inner circumferential surface of the stationary impeller opening.

The two surfaces delimiting the gap may be designed as even surfaces.

According to another embodiment the gap comprises a plurality of lands consecutively arranged with respect to the axial direction, wherein two adjacent lands are respectively separated by a groove. In such an embodiment the two surfaces delimiting the gap are not even. The part of the outer circumferential surface of the impeller's front delimiting the gap or the part of the inner circumferential surface of the stationary impeller opening delimiting the gap may include a plurality of lands and grooves there between. In such an embodiment the width of the gap is defined as the minimum distance in radial direction between the front shroud and the stationary impeller opening along the gap. This is the distance between the land and the surface facing the land with respect to the radial direction. For such an embodiment the length of the gap in axial direction is defined as the sum of the lengths of all individual lands in the axial direction. The grooves do not contribute to the overall length of the gap in axial direction.

According to a preferred embodiment, the stationary inlet opening comprises a wear ring delimiting the gap with respect to the radial direction, the wear ring being arranged stationary with respect to the casing.

Supplementary or as an alternative measure it is also possible that the impeller comprises a wear ring delimiting the gap with respect to the radial direction, the wear ring being arranged stationary with respect to the impeller.

The invention is especially suited for many types of centrifugal pumps. The pump may be designed for example as a single suction pump or a double suction pump, as a single stage pump or as a multistage pump. When the pump is designed as a single suction pump it may have a rear shroud on the impeller in addition to the front shroud. In such a design it is also possible that the rear shroud of the impeller forms a gap with a part being stationary with respect to the casing. This gap at the rear shroud may be designed in an analogously same manner as it is explained with respect to the gap at the front shroud of the impeller.

According to a preferred embodiment the pump is designed as a double suction pump, having a second inlet for the fluid being arranged oppositely to the first inlet of the pump, wherein the impeller is designed as a double suction impeller comprising vanes for conveying the fluid both from the first inlet and from the second inlet to the outlet.

For such a design as a double suction pump it is preferred, that the impeller comprises a second front shroud facing the second inlet of the pump, wherein the casing includes a second stationary impeller opening for receiving the second front shroud of the impeller and having a diameter, wherein the second front shroud and the second stationary impeller opening form a second gap having a width in the radial direction perpendicular to the axial direction, and wherein the ratio of the width of the second gap and the diameter of the second impeller opening is at least 0.0045.

Depending on the specific application it may be preferred that also the ratio of the width of the second gap and the diameter of the second impeller opening is at most 0.073 and preferably at most 0.055.

There are also applications for which it is advantageous when the ratio of the length of the second gap and the diameter of the second impeller opening is at least 0.0050.

Also for the second gap it is advantageous, when the second gap has a length in the axial direction which is at least 0.092 times the diameter of the second impeller opening.

Also with respect to the second gap it is a preferred measure, when the second stationary inlet opening comprises a second wear ring delimiting the second gap with respect to the radial direction, the second wear ring being arranged stationary with respect to the casing.

Supplementary or as an alternative measure it is also possible that the impeller comprises a second wear ring delimiting the gap with respect to the radial direction, the wear ring being arranged stationary with respect to the impeller. Preferably this second wear ring is mounted to the second front shroud of the impeller.

It is an especially preferred measure when the gap and the second gap are designed essentially in an identical manner.

For many applications it is preferred when the pump is designed as a centrifugal pump, in particular as a single stage centrifugal pump.

According to an essential application the pump is designed for the use in the oil and gas industry.

Further advantageous measures and embodiments of the invention will become apparent from the dependent claims.

BRIEF DESCRIPTION OF THE DRAWINGS

The invention will be explained in more detail hereinafter with reference to the drawings.

DETAILED DESCRIPTION OF THE EMBODIMENTS

Figure 1:
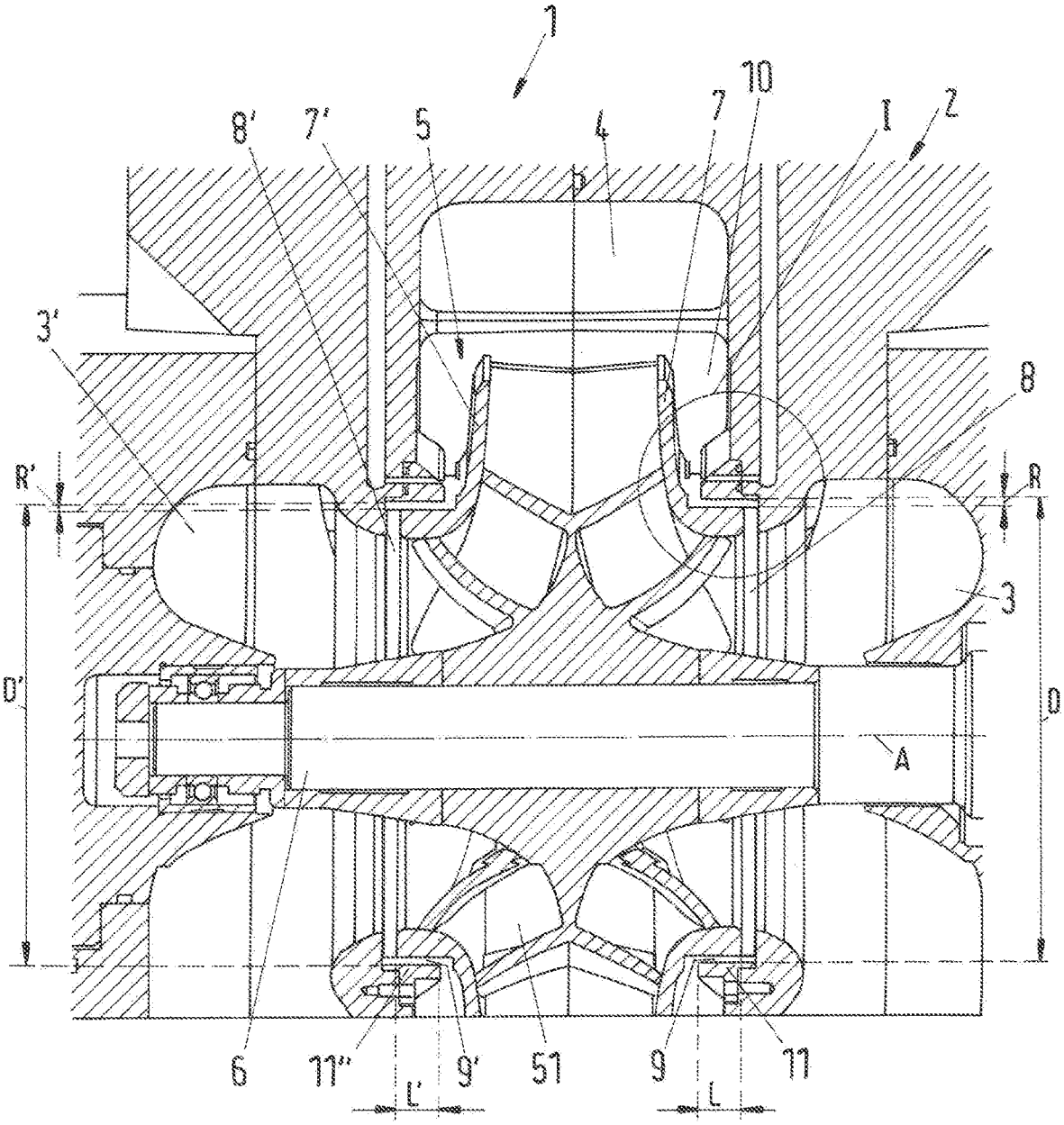
FIG. 1 is a cross-sectional view of an embodiment of a pump according to the invention.
Figure 2:
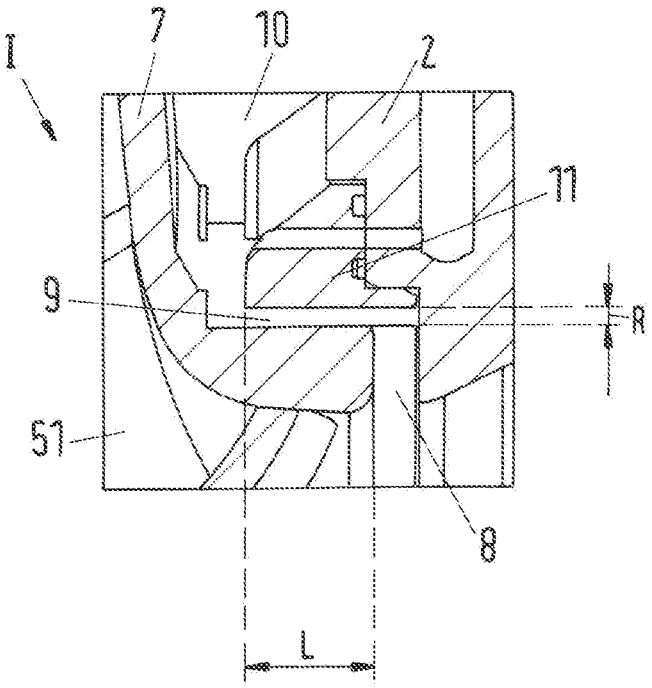
FIG. 2 is an enlarged representation of detail I in FIG. 1.

FIG. 1 shows a cross-sectional view of an embodiment of a pump according to the invention which is designated in its entity with reference numeral 1. FIG. 2 shows an enlarged representation of detail I in FIG. 1. The pump 1 is designed for conveying a highly viscous fluid, whereas the term "highly viscous" has the meaning that the kinematic viscosity of the fluid is at least $10^{-4}$ $m^2/s$, which is 100 centistokes (cSt).

In this embodiment the pump 1 is designed as a double suction single stage centrifugal pump. This design is one preferred embodiment which is in practice useful for many applications. Of course, the invention in not restricted to this design. A pump according to the invention may also be designed as a single suction centrifugal pump or as a multistage centrifugal pump or as any other type of centrifugal pump. Based upon the description of the embodiment shown in FIG. 1 and FIG. 2 it is no problem for the skilled person to build a pump according to the invention, that is designed as another type of pump, especially centrifugal pump, for example a single suction pump.

The double suction pump 1 comprises a casing 2 with a first inlet 3, a second inlet 3' and an outlet 4 for the fluid to be pumped. The fluid may be for example crude oil, oil or any other hydrocarbon fluid being highly viscous. The pump 1 has an impeller 5 with a plurality of vanes 51 for conveying the fluid from the first inlet 3 and the second inlet 3' to the outlet 4. The impeller 5 is arranged on a rotatable shaft 6 for rotation around an axial direction A. The axial direction A is defined by the axis of the shaft 6 around which the impeller 5 rotates during operation. The shaft 6 is rotated by a drive unit (not shown).

The direction perpendicular to the axial direction A is referred to as the radial direction.

The first inlet 3 and the second inlet 3' are arranged oppositely to the first inlet with respect to the axial direction A. Thus, according to the representation in FIG. 1, the fluid is flowing both from the left side and from the right side in axial direction A to the impeller 5, whereas the fluid from the first inlet 3 is flowing in opposite direction to the impeller as the fluid from the second inlet 3'. The impeller 5 conveys both the fluid coming from the first inlet 3 and the fluid coming from the second inlet 3' into the radial direction to the outlet 4 of the pump.

The impeller 5 comprises a front shroud 7 covering the vanes 51 and facing the first inlet 3 of the pump 1. Since in this embodiment the impeller 5 is designed as a double suction impeller 5 it comprises a second front shroud 7' facing the second inlet 3' and covering the vanes 51 on the side of the impeller 5 which faces the second inlet 3'.

The casing 2 includes a stationary impeller opening 8 for receiving the front shroud 7 of the impeller 5. The stationary impeller opening 8 is stationary with respect to the casing 2 of the pump 1 and has a circular cross-section with a diameter D, whereas the diameter D designates the smallest diameter of that part of the stationary impeller opening 8 which receives the front shroud 7.

In an analogous manner the casing 2 comprises a second stationary impeller opening 8' for receiving the second front shroud 7' of the impeller 5.

In the mounted state the impeller 5 is arranged coaxially within the stationary impeller opening 8 such that the outer circumferential surface of the front shroud 7 faces the inner circumferential surface of the stationary impeller opening 8. Thus, the front shroud 7 and the stationary impeller opening 8 form a gap 9 (see also FIG. 3) between the front shroud 7 and the stationary impeller opening 8. The gap 9 is also called a labyrinth. It has an essentially annular shape and provides sealing action as will be explained hereinafter.

The gap 9 has a width R in the radial direction between the front shroud 7 and the stationary impeller opening 8. The width R, i.e. the extension of the gap 9 in radial direction, is also referred to as radial clearance R and may be constant along the axial extension of the gap 9. The radial clearance R designates the minimum radial clearance along the gap 9.

The second parameter defining the geometry of the gap 9 is the length L of the gap 9 which is the extension of the gap 9 in the axial direction A. The gap 9 extends parallel to the shaft 6 or parallel to the axial direction A, respectively. Thus, the back flow is flowing through the gap 9 parallel to the shaft 6 and in the opposite direction as the fluid flowing through the respective inlet 3. Thus, viewed in the main flow direction of the fluid entering through the respective inlet 3 the starting position of the gap 9, i.e. the opening through which the fluid enters the gap 9, is arranged behind the ending position of the gap 9, i.e. the opening through which the fluid leaves the gap 9.

In an analogous manner a second gap 9' is formed between the second front shroud 7' and the second stationary impeller opening 8'. The second gap 9' has a width R' in radial direction and a length L' in the axial direction A. The second stationary impeller opening 8' has a diameter D'. The gap 9' extends parallel to the shaft 6 or parallel to the axial direction A, respectively. Preferably, but not necessarily, the width R' equals the width R and the length L' equals the length L and the diameter D' equals the diameter D. Since the design and the arrangement of the second gap 9' may be identical as the gap 9 the following description will only refer to the gap 9. It shall be understood that this description applies in an analogously same manner also for the second gap 9'.

The gap 9 or the labyrinth 9 seals a side room 10 located on the high pressure side of the impeller 5 against the low pressure side of the impeller 5 which is located at the inlet 3. The side room 10 is located at the high pressure side of the impeller 5 near the outlet 4 of the pump 1 and delimited by the front shroud 7 of the impeller 5 as well as by the casing 2 of the pump 1. During operation of the pump 1 a back flow is generated from the region of the outlet 4 through the side room 10. The back flow passes the gap or the labyrinth 9 flowing essentially in the axial direction A, i.e. parallel to the shaft 6 and reaches the low pressure side of the impeller 5 next to the first inlet 3. It is obvious that the back flow reduces the efficiency of the pump 1.

Thus, it is one of the functions of the gap 9 to provide some sealing action to limit the back flow. That is the reason why the gap 9 is also called labyrinth.

It is the basic idea of the present invention to design the width R (see FIG. 2 and FIG. 3) of the gap 9 in the radial direction bigger or larger as compared to solutions known from the prior art. Although one could expect that a larger width R would result in an increased back flow which in turn reduces the pump efficiency, it has been realized that by making larger the width R of the gap 9 the overall efficiency of the pump 1 may be increased.

Figure 3:
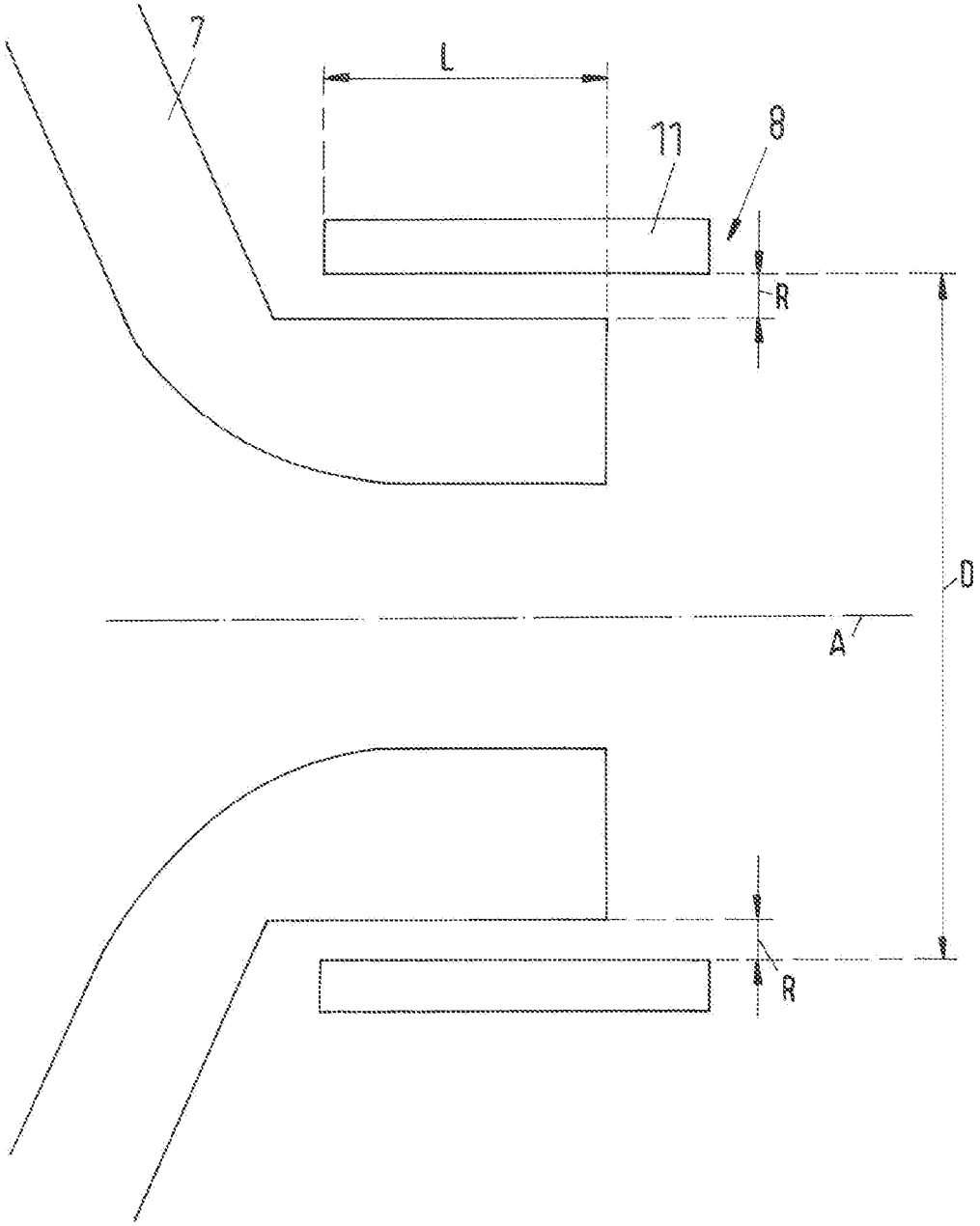
FIG. 3 is a sketch of the front shroud and a wear ring as part of the stationary impeller opening.

Referring to FIG. 2 and FIG. 3 the design of the gap 9 will now be explained in more detail. In the embodiment according to FIG. 1 the stationary inlet opening 8 comprises a wear ring 11 delimiting the gap 9 with respect to the radial direction. The wear ring 11 faces the outer circumferential surface of the front shroud 7 that is inserted in the stationary inlet opening 8. The wear ring 11 is fixedly mounted to the casing 2, thus, the wear ring 11 is stationary with respect to the casing 2.

FIG. 3 shows a sketch of the front shroud 7 and the wear ring 11 as part of the stationary impeller opening 8 to more clearly understand the dimensions of the gap 9.

Figure 4:
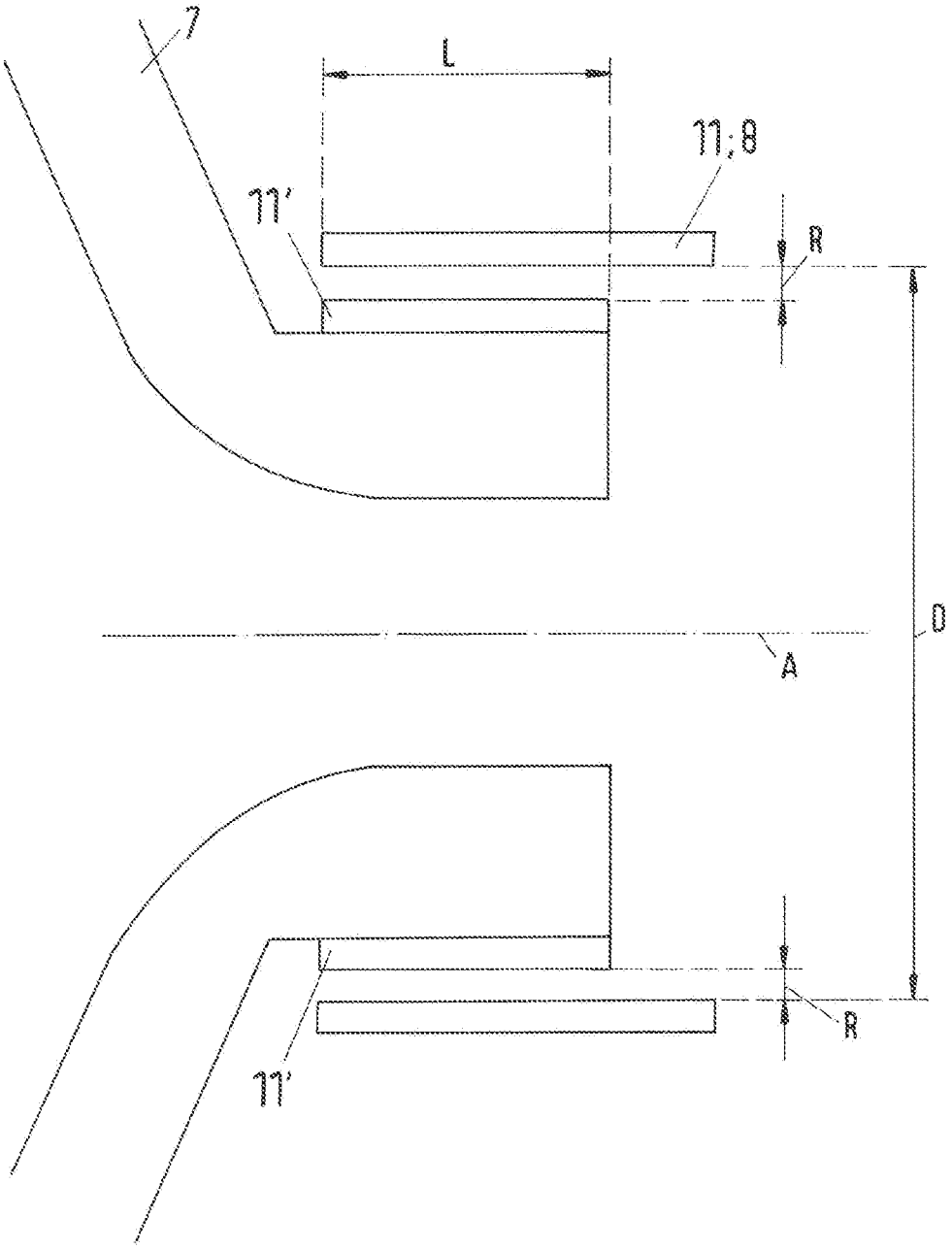
FIG. 4 is as FIG. 3, but for a variant of the embodiment.

It shall be understood that in an analogous manner also the second stationary inlet opening 8' may comprise a second wear ring 11" (see FIG. 1) delimiting the second gap 9' with respect to the radial direction. The second wear ring 11" may be arranged stationary with respect to the casing 2 as shown in FIG. 1 or the second wear ring may be stationary with the impeller 5 in the same manner as shown in FIG. 4.

According to the invention the width R of the gap 9 is designed such that the ratio of the width R and the diameter D of the impeller opening 8 is at least 0.0045, i.e. $R/D \geq 0.0045$. As already said, the diameter D designates the smallest diameter of the stationary impeller opening 8, i.e. the diameter at that location were the wear ring 11 comes closest to the outer circumferential surface of the front shroud 7. The width R of the gap 9 is the extension in radial of that region where the stationary impeller opening 8 and the front shroud 7 come closest to each other.

The second parameter defining the geometry of the gap 9 is the length L of the gap 9 in axial direction A between the front shroud 7 and the stationary impeller opening 8 or the wear ring 11, respectively. The length L of the gap 9 is the extension in axial direction A of that region where the stationary impeller opening 8 and the front shroud 7 come closest to each other.

In practice it has been proven as advantageous, when the length L of the gap 9 is at least 0.092 times the diameter D of the impeller opening 8, i.e. preferably the condition $L/D \geq 0.092$ is fulfilled.

The optimal width R of the gap 9 depends on the respective application. There are several factors influencing an appropriate choice of the width R of the gap 9, for example the kinematic viscosity of the specific fluid to be pumped, the pressure increase generated by the pump, the flow through the pump or other operational parameters of the pump 1.

For a given set of operational parameters of the pump 1 the width R of the gap 9 should preferably be increased with increasing viscosity of the fluid to be pumped.

In practice and depending on the application it may be preferred that the ratio R/D is at least 0.0050.

According to the preferred embodiments of the pump 1 the maximum ratio RID is 0.0070, i.e. the width R of the gap 9 is preferably at most 0.0070 times the diameter of the stationary impeller opening 8 or the wear ring 11, respectively. However there might be applications, where it is preferred that the width R of the gap 9 is even larger than 0.0070 times the diameter of the stationary impeller opening 8.

FIG. 4 shows in a similar representation as FIG. 3, a variant of the embodiment of the pump 1. According to this variant the impeller 5 and more particular the front shroud 7 of the impeller 5 comprises a wear ring 11' delimiting the gap 9 with respect to the radial direction. The wear ring 11' is fixedly connected to the impeller 5 and rotating with the impeller 5. In this variant the stationary impeller opening 8 may comprise a wear ring 11, too, but may also be designed without a wear ring.

Figure 5:
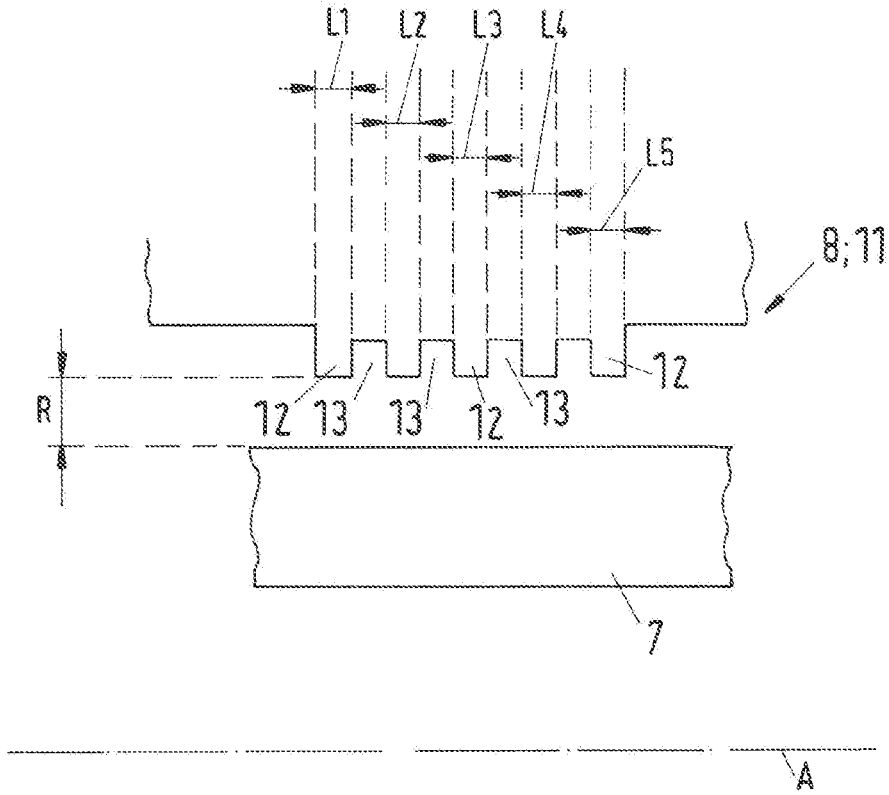
FIG. 5 is a second variant for the design of the gap between the front shroud and the stationary impeller opening.

FIG. 5 illustrates a second variant for the design of the gap 9 between the front shroud 7 and the stationary impeller opening 8. According to the second variant the stationary impeller opening 8 or the wear ring 11, respectively, or as an alternative (not shown) the front shroud 7 is designed such that the gap 9 comprises a plurality of lands 12 consecutively arranged with respect to the axial direction A, wherein two adjacent lands 12 are respectively separated by a groove 13. In such a design, the total length L of the gap 9 is the sum of the individual lengths L1, L2, L3, L4, L5 of all lands 12 in the axial direction. The extension of the grooves does not contribute to the total lengths L of the gap 9, i.e. L=L1+L2+L3+L4+L5. The width R in the radial direction is the distance between the lands 12 and the outer circumferential surface of the front shroud 7 in radial direction. It shall be understood that the number of lands and grooves as well as their geometric design shown in FIG. 5 are only exemplary.

The pump 1 according to the invention has a better pump efficiency as compared to pumps known from the state of the art. The pump efficiency designates the ratio of the power delivered by the pump and the power input for the pump, i.e. the power that is used to drive the pump. The power delivered by the pump is usually the hydraulic power generated by the pump 1.

Figure 6:
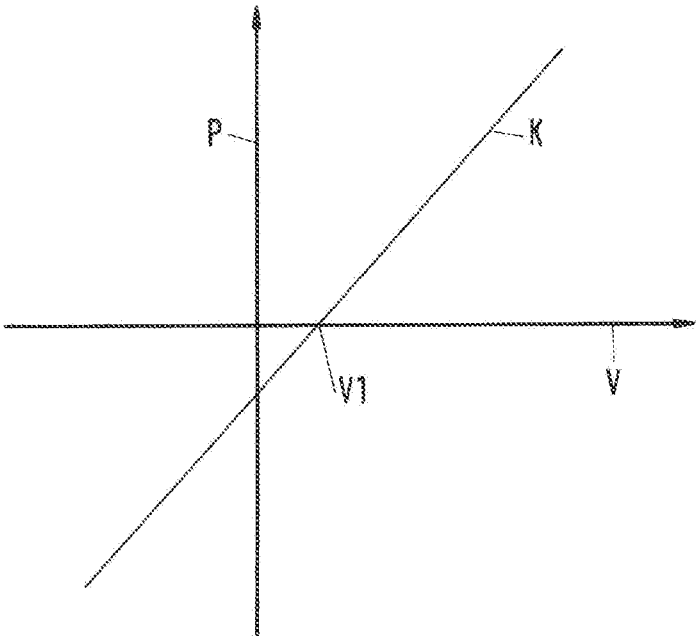
FIG. 6 is an illustration of a comparison of a pump according to the invention with prior art pumps.

FIG. 6 illustrates a comparison of a pump according to the invention with prior art pumps. The graph shows the pump efficiency P as a function of the viscosity V of the fluid conveyed by the pump. For the purpose of a better understanding the graph is standardized such that the pump efficiency P of the prior art pumps equals the horizontal viscosity axis V, i.e. the pump efficiency P for the pump according to the prior art lies always on the V-axis for each viscosity. Thus, the graph directly shows the increase of the pump efficiency of the pump 1 according to the invention as compared to a prior art pump. The pump efficiency of the pump according to the invention is represented by the curve K. As can be clearly seen, as soon as the viscosity of the fluid is greater than a specific value V1 the pump 1 according to the invention has an increased pump efficiency compared to the prior art pump. The efficiency gain is increasing with the viscosity of the fluid. The specific value V1 of the viscosity where the pump 1 according to the invention becomes more efficient than the prior art pump is usually smaller than the value of $10^{-4}$ $m^2/s$. Thus, for a highly viscous fluid the pump 1 according to the invention has a higher pump efficiency than the prior art pump.

Although specific reference has been made for the purpose of explanation to an embodiment, where the pump 1 is designed as a double suction single stage centrifugal pump the invention is in no way restricted to such embodiments. The pump according to the invention may also be designed as any other type of centrifugal pump, for example as a single suction pump or as a multistage pump. In particular, the invention is applicable both to centrifugal pumps with a closed impeller, i.e. an impeller having a front shroud and a rear shroud, and to centrifugal pumps with a semi-open impeller, i.e. having a rear shroud but no front shroud. In such designs where the impeller has a rear shroud or a rear shroud only, the design of the gap 9 according to the invention may be used for the rear shroud in an analogously same manner as herein described with reference to the front shroud.

The invention claimed is:

1. A pump for conveying a highly viscous fluid, comprising:

a casing with at least a first inlet and an outlet for the highly viscous fluid;

an impeller configured to convey the highly viscous fluid from the first inlet to the outlet, the impeller being arranged on a rotatable shaft for rotation about an axial direction, and comprising a front shroud facing the first inlet of the pump, the casing including a stationary impeller opening configured to receive the front shroud of the impeller, the stationary impeller opening having a diameter, the front shroud and the stationary impeller opening forming a gap having a width in a radial direction perpendicular to the axial direction, and the gap extending parallel to the rotatable shaft, a ratio of the width of the gap and the diameter of the stationary impeller opening being at least 0.0045, and the gap having a length in the axial direction which is at least 0.092 times the diameter of the impeller opening, wherein the length extends between an outer circumferential surface of the front shroud and an inner circumferential surface of the stationary impeller opening.

2. A pump in accordance with claim 1, wherein the ratio of the width of the gap and the diameter of the stationary impeller opening is at least 0.0050.

3. A pump in accordance with claim 1 wherein the ratio of the width of the gap and the diameter of the stationary impeller opening is at most 0.0070.

4. A pump in accordance with claim 1, wherein the gap comprises a plurality of lands consecutively arranged with respect to the axial direction and two adjacent lands of the plurality of lands are separated by a groove.

5. A pump in accordance with claim 1, wherein the stationary impeller opening comprises a wear ring delimiting the gap with respect to the radial direction, the wear ring being arranged stationary with respect to the casing.

6. A pump in accordance with claim 1, wherein the impeller comprises a wear ring delimiting the gap with respect to the radial direction, the wear ring being arranged stationary with respect to the impeller.

7. A pump in accordance with claim 1, wherein the pump is a double suction pump having a second inlet for the fluid being arranged oppositely to the first inlet of the pump, and the impeller is a double suction impeller comprising vanes for conveying the fluid both from the first inlet and from the second inlet to the outlet.

8. A pump in accordance with claim 7, wherein the front shroud is a first front shroud, and the impeller comprises a second front shroud facing the second inlet of the pump, the casing includes a second stationary impeller opening configured to receive the second front shroud of the impeller and having a diameter, wherein the second front shroud and the second stationary impeller opening form a gap having a width in the radial direction perpendicular to the axial direction, and the ratio of the width of the gap formed by the second front shroud and the second stationary impeller opening and a diameter of the second stationary impeller opening is at least 0.0045.

9. A pump in accordance with claim 8, wherein the ratio of the width of the gap formed by the second front shroud and the second stationary impeller opening and the diameter of the second stationary impeller opening is at least 0.0050.

10. A pump in accordance with claim 8 wherein the gap formed by the second front shroud and the second stationary impeller opening has a length in the axial direction which is at least 0.092 times the diameter of the second stationary impeller opening.

11. A pump in accordance with claim 8, wherein the second stationary impeller opening comprises a wear ring delimiting the gap formed by the second front shroud and the second stationary impeller opening with respect to the radial direction, the wear ring being arranged stationary with respect to the casing.

12. A pump in accordance with claim 8, wherein the gap formed by the first front shroud and the first stationary impeller opening and the second gap formed by the second front shroud and the second stationary impeller opening are substantially identical.

13. A pump in accordance with claim 1, wherein the pump is a centrifugal pump.

14. A method comprising:

operating a pump in accordance with claim 1 in the oil and gas industry.

15. A pump in accordance with claim 1, wherein the pump is a single stage centrifugal pump.

* * * * *